US006561920B1

(12) United States Patent
Hamilton

(10) Patent No.: US 6,561,920 B1
(45) Date of Patent: May 13, 2003

(54) GOLF STROKE TRAINING DEVICE AND METHOD

(76) Inventor: David Paul Hamilton, P.O. Box 165, Shannon, MS (US) 38868

( * ) Notice: Subject to any disclaimer, the term of this patent is extended or adjusted under 35 U.S.C. 154(b) by 0 days.

(21) Appl. No.: 10/101,087

(22) Filed: Mar. 19, 2002

(51) Int. Cl.[7] ..... A63B 69/36
(52) U.S. Cl. ..... 473/257; 473/257; 473/219
(58) Field of Search ..... 473/257, 219, 473/258, 260, 261, 262, 270

(56) References Cited

U.S. PATENT DOCUMENTS

| | | | | | |
|---|---|---|---|---|---|
| 1,409,688 | A | | 3/1922 | Edgar | |
| 1,637,339 | A | | 8/1927 | Glennon | |
| D117,600 | S | | 11/1939 | Schneider | |
| 2,611,610 | A | * | 9/1952 | Hara | 473/271 |
| 3,460,837 | A | | 8/1969 | Cassa, Jr. | |
| 3,874,673 | A | * | 4/1975 | Beard | 473/262 |
| 4,355,810 | A | | 10/1982 | Rydeck | |
| 4,900,030 | A | | 2/1990 | Houtz | |
| 4,915,387 | A | | 4/1990 | Baxstrom | |
| 5,007,646 | A | * | 4/1991 | Baber et al. | 473/261 |
| 5,024,442 | A | | 6/1991 | Sindelar, Sr. | |
| 5,282,627 | A | | 2/1994 | Beck | |
| 5,332,211 | A | * | 7/1994 | Rife et al. | 273/DIG. 21 |
| 5,346,220 | A | | 9/1994 | Cooper | |
| 5,388,833 | A | | 2/1995 | Goyen, Jr. | |
| 5,417,428 | A | | 5/1995 | Warren | |
| 5,435,547 | A | | 7/1995 | Lee | |
| 5,527,037 | A | * | 6/1996 | Matsumoto | 473/218 |
| 5,549,298 | A | | 8/1996 | Cullen | |
| 5,672,114 | A | | 9/1997 | Tu | |
| 5,855,523 | A | | 1/1999 | Hatchett | |
| 5,997,410 | A | | 12/1999 | Northdurft | |
| 6,159,106 | A | | 12/2000 | Adams | |

* cited by examiner

*Primary Examiner*—Paul T. Sewell
*Assistant Examiner*—Nini F. Legesse
(74) *Attorney, Agent, or Firm*—John V. Stewart

(57) ABSTRACT

A golf putting guide that is placed on the ground between a golfer and a golf ball. It has a vertical front surface facing the ball that is part of the elliptical vertical projection of a desired swing circle of the club head. The heel of the club head slides along the front surface of the guide in putting practice, guiding the club head in a planar swing circle that is centered between the golfer's shoulders. The top surface of the guide is marked with a series of club face alignment lines extending backward from the top front edge of the guide. Each of these lines is perpendicular to a line tangent to the elliptical top front edge of the guide. These lines visually guide the alignment of the club head as it moves along the front surface of the guide so the club rotates only on a single axis.

14 Claims, 5 Drawing Sheets

16
15
15
10
14
14
5
3
11
2
17
4
13
1
12
T 16
10
15
3
11
17
6
12
14

GOLF STROKE TRAINING DEVICE AND METHOD

BACKGROUND OF THE INVENTION

1. Field of the Invention

This invention relates to golf putting practice guides that are placed on the ground between a golfer and a golf ball to physically and visually guide a proper putting stroke during training exercises.

2. Description of Prior Art

Numerous prior U.S. patents show a wide variety of golf putting guides, including visual guides and physical guides. The visual guides provide marks for placement of a golfer's feet and the ball, and may include lines or arcs indicating a path of a club head for various strokes and golfer statures. The physical guides channel a club head along a desired stroke path by providing a physical channel or barrier, between or along which the club head moves, and/or by other restraints such a tethers.

However none of the prior devices provides physical and visual guidance of the heel of a golf club head along an ideal swing path combined with visual guidance of the club face alignment, such that the club shaft and head rotate in unison about a single predetermined axis to generate a perfectly rotating putting stroke throughout the foreswing and follow-through.

For example, U.S. Pat. No. 1,409,688 of Edgar discloses a golf stroke practice device that physically guides the toe of the golf club head along a desired arc on the foreswing. There are two basic problems with this approach. First, the toe of a golf head is more easily torqued by friction against a guide than is the heel, thus easily twisting the club out of alignment. Second, Edgar's guide cannot provide the same arc on the follow-through, because the guide would approach the path of the ball. This could cause the ball to strike the guide, or cause a golfer to unconsciously pull the stroke to miss the guide, rather than performing a perfect, symmetric stroke. Thus, on Edgar, the guide arc ends at the ball and becomes a straight line on the follow-through. This is not ideal or complete guidance.

Other golfing stroke guides in the prior art have a variety of disadvantages particular to each one, never reaching the simplicity, convenience, practicality, and completeness of the present invention. None of them have the type of club face alignment marks provided by the present invention for eliminating rotation of the club around a second rotation axis along the club shaft that tends to occur during a stroke.

SUMMARY OF THE INVENTION

The main object of this invention is to provide a golf putting practice device that physically and visually guides a proper putting stroke during training exercises. The putting stroke to be produced is such that the club shaft and club head rotate in unison about a single axis that passes through a point between the shoulders of a golfer. This moves the club head in a circular arc tangent to the ground in a plane that is angled from the vertical.

A further object is lateral symmetry that allows the guide to be used equally well by left-handed and right-handed golfers. A further object is convenience in handling and carrying the guide to a practice site, and in storing the device compactly. A further object is a high degree of sturdiness. A further object is simplicity of construction. A further object is minimum production cost.

The objectives of the present invention are achieved by provision of a golf putting guide that is placed on the ground between a golfer and a golf ball. It has a vertical front surface facing the ball that is part of the vertical projection of a swing circle of the club head. The heel of the club head slides along the front surface of the guide in a planar swing circle that is centered between the golfer's shoulders. The top surface of the guide is marked with a series of club face alignment marks, each of which is a line that extends perpendicularly backward from an imaginary line tangent to the elliptical top front edge of the guide. These marks visually guide the alignment of the club face as it moves along the front surface of the guide. This guides the stroke such that the club shaft and club head rotate in unison about a single axis that passes through a point between the shoulders of the golfer.

REFERENCE NUMBERS

Figure 1:
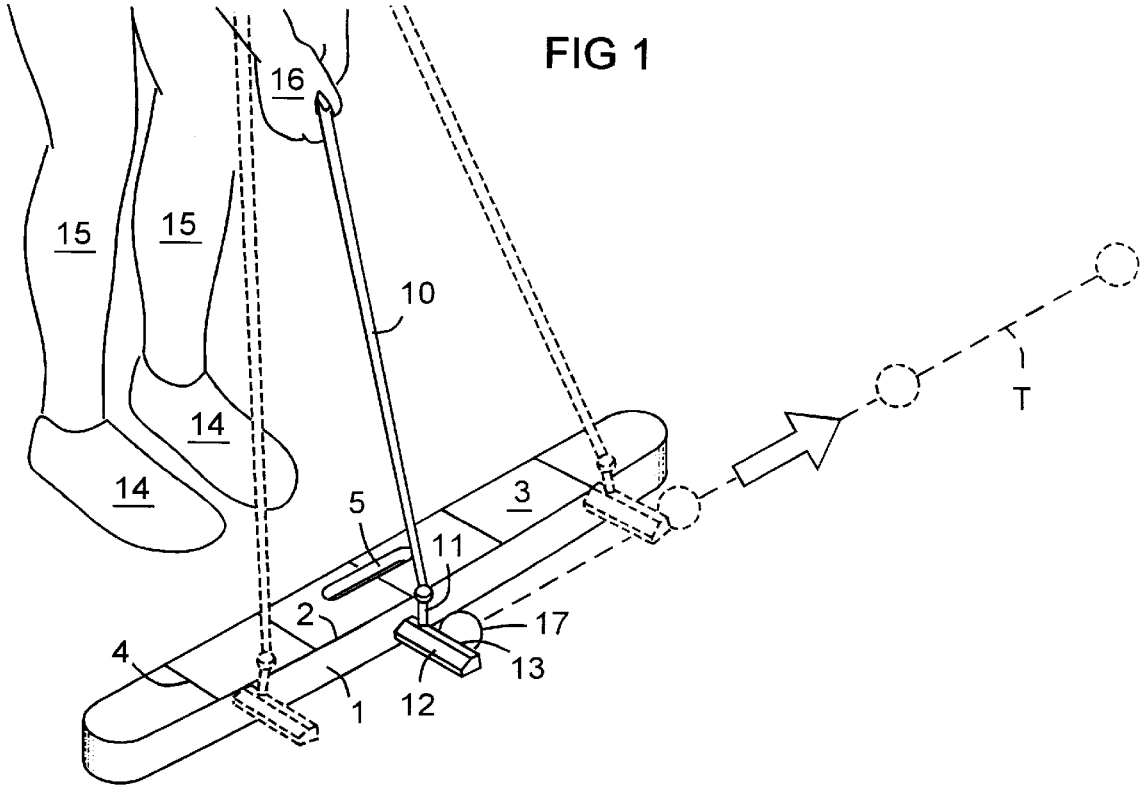
FIG. 1 is a right front view of the invention in use.
Figure 2:
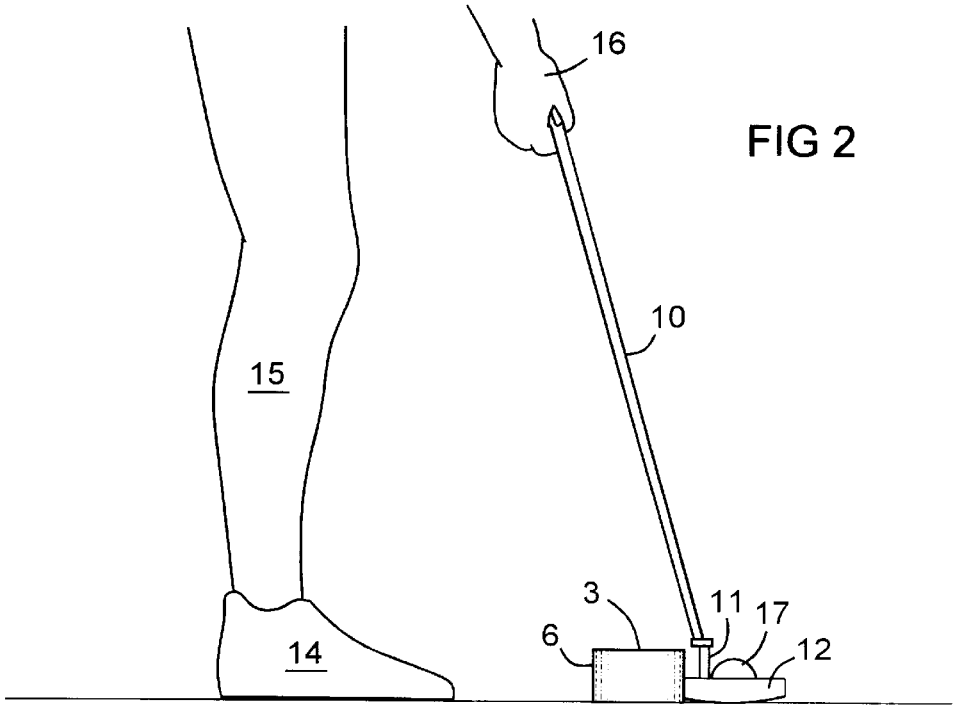
FIG. 2 is a right side view of the invention in use.
Figure 3:
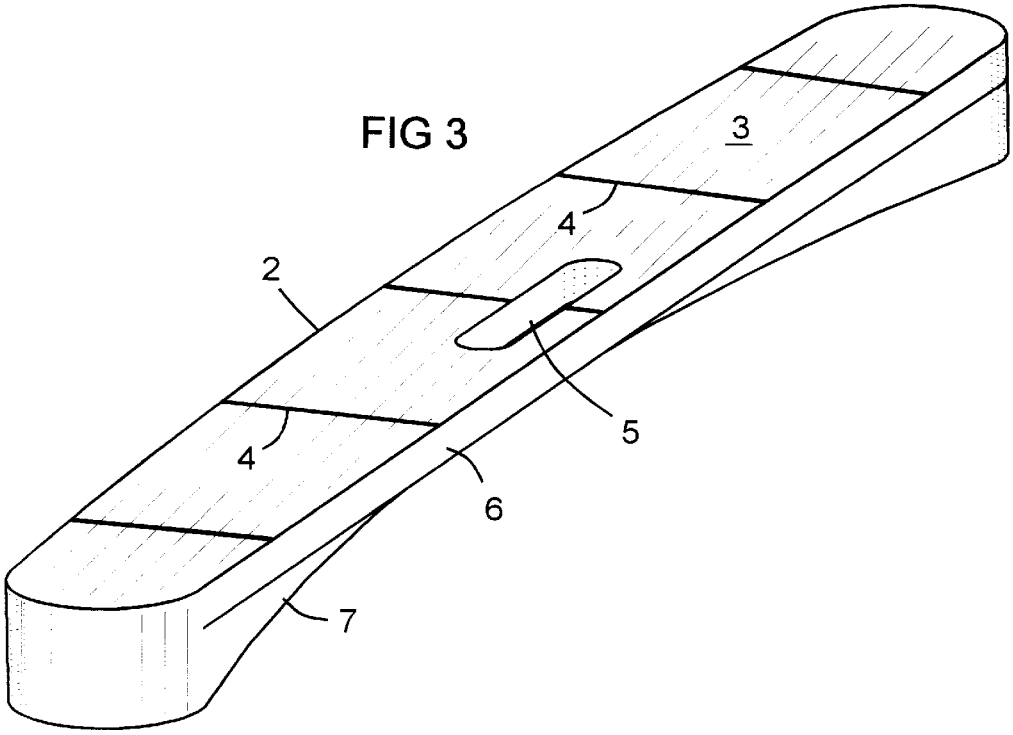
FIG. 3 is a top left perspective view of the invention.
Figure 4:
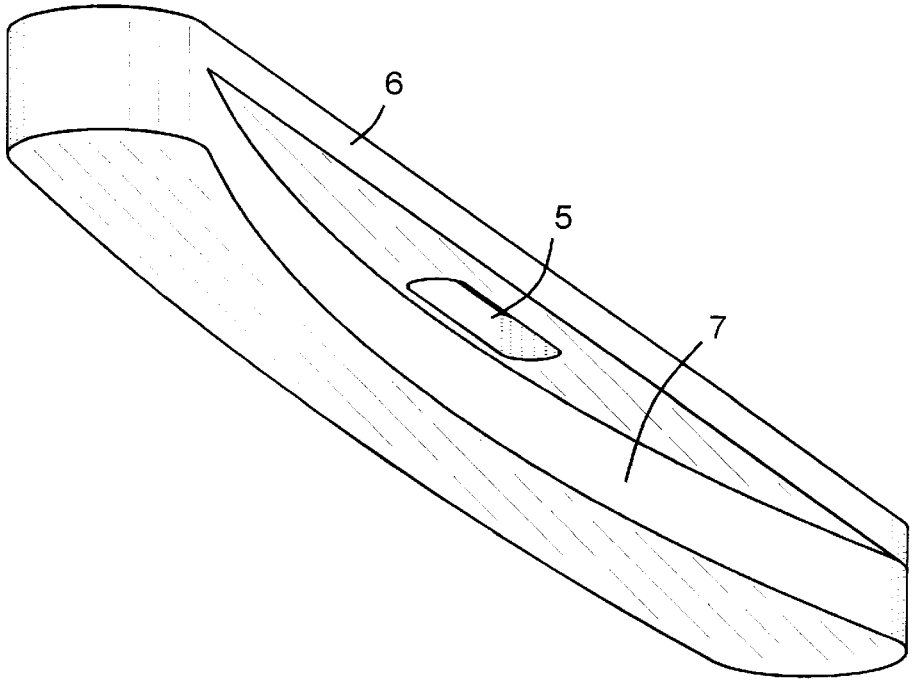
FIG. 4 is a bottom left perspective view of the invention.
Figure 5:
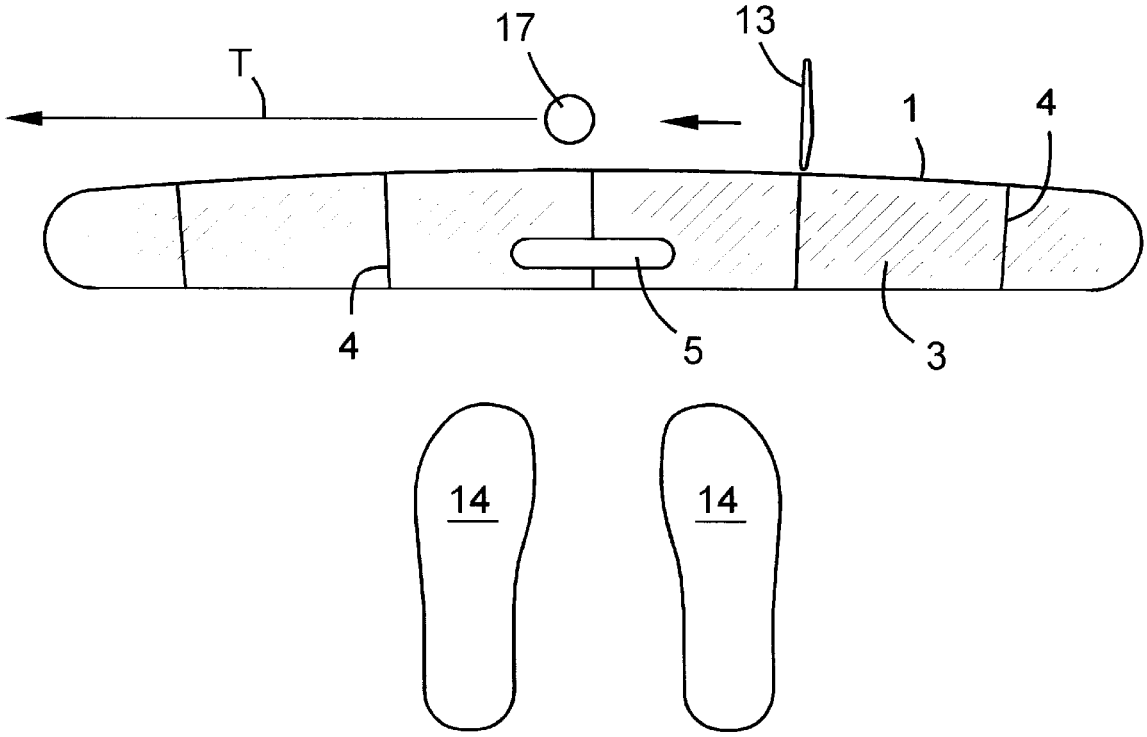
FIG. 5 is a top view of the invention in use.
Figure 6:
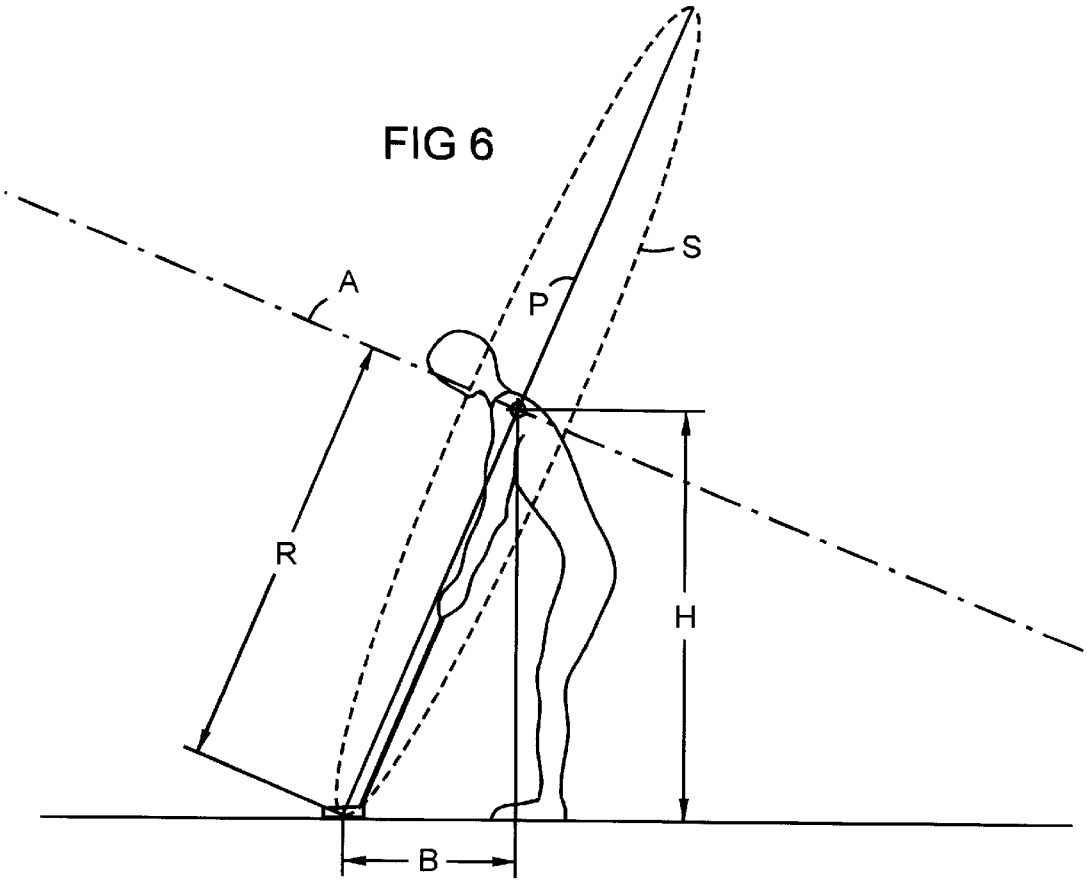
FIG. 6 is a side view of a golfer showing the geometric parameters used in the product design.
Figure 7:
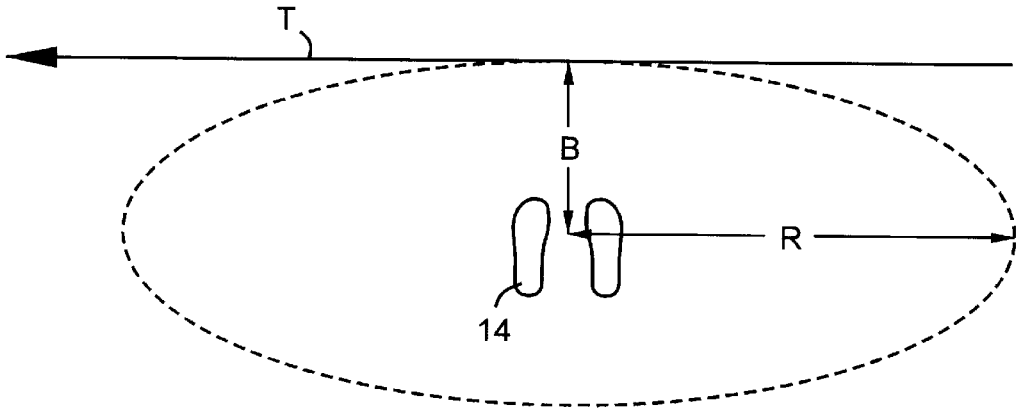
FIG. 7 is a top view of the projection of the swing circle on the ground.
Figure 8:
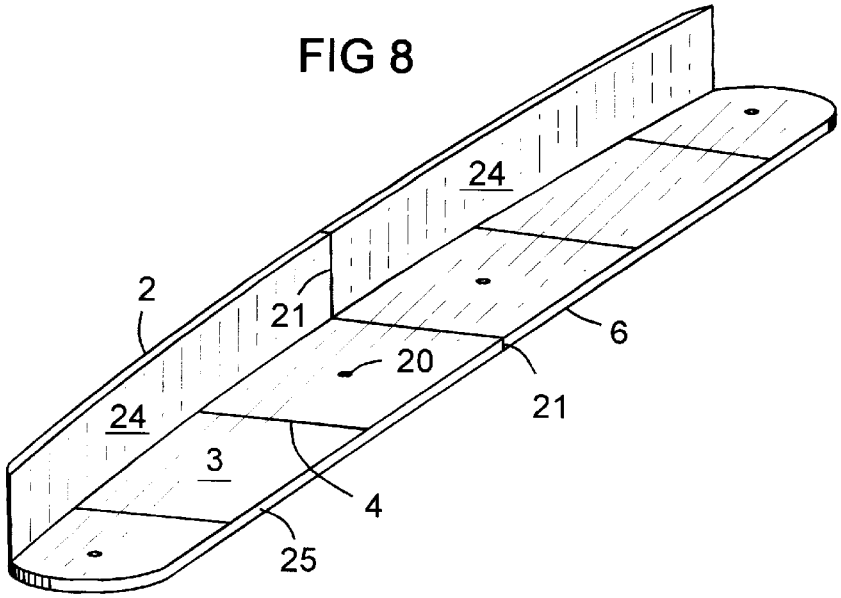
FIG. 8 is a top left perspective view of a second embodiment of the invention.
Figure 9:
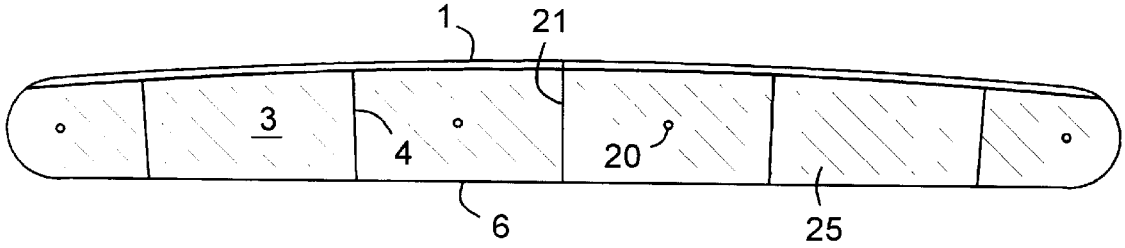
FIG. 9 is a top view of FIG. 8.

1. Front surface of guide
2. Upper front edge of guide
3. Top surface of guide
4. Alignment marks on top surface
5. Carrying grip hole
6. Back of guide
7. Undercut portion of back of guide
10. Putter club shaft
11. Vertical "ankle" portion of putter club shaft
12. Putter club head
13. Putter club head face
14. Foot of golfer
15. Leg of golfer
16. Hand of golfer
17. Golf ball
18. Golf tee
20. Hole for stake or golf tee to fix the guide to the ground
21. Optional separation joint between halves of guide
22. Optional hinge between left and right sections of guide
23. Optional overlapping joint between left and right sections of guide
24. Front rise of approximate "L" channel form of second embodiment
25. Ground plate of approximate "L" channel form of second embodiment
A. Axis of swing rotation
B. Horizontal distance from center of swing circle to ball.
H. Height of center of swing circle above the ground.
P. Swing plane.

R. Radius of swing circle from center of circle to center of club face.

S. Swing circle from center of circle to center of club face.

T. Ball-to-target line or trajectory

TERMINOLOGY

Front, Back, Left, Right

These directional terms are used in relation to a golfer addressing a ball. The front surface of the guide is the surface facing the ball before it is struck. The back surface of the guide is the surface facing the golfer.

Vertical Extrusion

This describes the shape of the front surface of the guide, not the fabrication technique. Any desired fabrication technique can be used to create this surface.

DETAILED DESCRIPTION

The invention is a guide that is placed on a golfing surface between a golfer and a golf ball to guide a putting stroke physically and visually during practice. It has a vertical front surface 1 facing the ball that is part of an elliptical vertical projection of a desired swing circle of a golf club head. This front surface physically guides the putter head along the desired golf swing. The heel of the putter head slides along this front surface during putting practice.

In addition, the face of the putter head is aligned visually by the golfer at several points along the stroke, so that the putter head and shaft rotate in unison about an imaginary single axis that passes between the golfer's shoulders. Club face alignment marks 4 are provided on the top surface 3 of the guide. Each of these marks is a line extending back from the front surface perpendicularly to an imaginary line tangent to the elliptical front surface of the guide at the mark. At the point of ball impact, the club head face is perpendicular to the desired target line.

A putter club having a vertical ankle section 11 is recommended for use with this device. The ankle provides clearance between the upper front edge 2 of the guide and the club shaft, so that only the heel of the club head touches the device.

The height of the front surface of the guide should be enough to accommodate the rise of the golf club head on the circular backswing and follow-through. A height of about 2 to 2.5 inches is suggested. A height greater than 3 inches is not recommended because the club shaft should not touch the upper front edge 2 of the guide. The front surface of the guide can be lower in the middle than at the sides if desired. However, this is unnecessary if the recommended putter club type is used. The back surface 6 of the guide is preferably undercut 7 to provide an area for a handle hole 5.

The ellipse used to form the front surface of the guide is the vertical projection on the ground of the desired circular path of the golf club head. This circular path is centered between the golfer's shoulders, and is in a plane angled from the vertical. The ideal ellipse or a given golfer depends on the golfer's height and putting plane angle. Thus, a variety of putting guides according to the invention smay be offered to closely match each golfer. Optionally, a putting guide according to the invention can be custom made for a golfer through CNC milling of the front surface of a guide using an elliptical equation based on the golfer's measured shoulder height and putting angle.

The equation of the ellipse providing the arc of the guide surface is shown below, where the ellipse is in a horizontal plane, the origin of the x, y coordinate system is the geometric center of the ellipse, the x direction is positive to the right, and the y direction is positive forward, relative to a golfer using the guide. B is the horizontal distance from the center of a desired swing circle to a golf ball to be struck, R is the radius of the desired swing circle.

$$Y = \pm \frac{B}{R}\sqrt{R^2 - X^2}$$

Only a portion of the positive half of the ellipse is used for the guide surface. The lateral extent of the guiding surface 1 is preferably about 30 to 40 inches. Thus the range and domain of the above equation is limited to define an elliptical arc that produces a guiding surface of a desired width.

Alternate swing circles can be used as the preferred swing circle, depending on the product designer's preference and teaching method. For example, a swing circle centered on the golfer's head could be used for the elliptical formula if desired.

Alternately, an arc that approximates the above ellipse over the lateral extent of the guiding surface can be used. For example, a circular arc with a 20-foot radius can be used. However, an elliptical arc per the equation above is preferred.

The material of the guide is preferably wood or plastic, but can be any desired material. Possible fabrication techniques include, but are not limited to, CNC milling and molding.

This guide is laterally symmetric, so it can be used for both right-handed and left-handed strokes equally. It provides both a visual and physical guide for the path and orientation of the golf club head.

Figure 10:
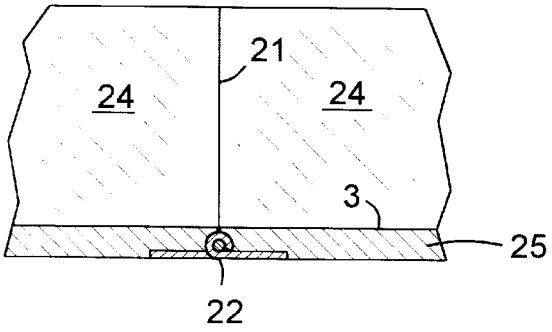
FIG. 10 is a back sectional view of a hinged center joint of the embodiment of FIG. 8.
Figure 11:
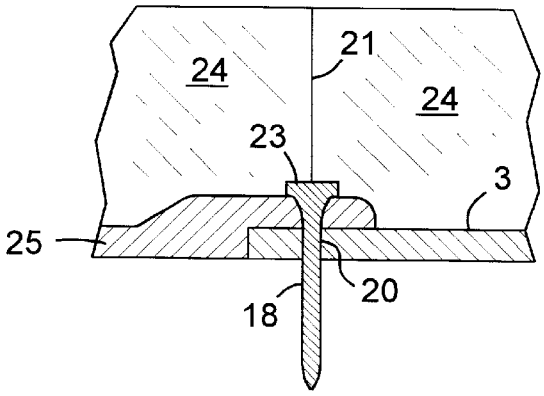
FIG. 11 is a back sectional view of a separable version of the center joint of the embodiment of FIG. 8.

A second embodiment of the invention is shown in FIGS. 8–11. This version uses the same stroke guidance concepts and essential geometry as in FIGS. 1–7, in a slightly different form. It has the form of an approximately L-shaped cross section, where a cross section is taken on a vertical plane through any of the club face alignment lines 4. The front guiding surface 1 is supported on a frontal rise 24 of the L shape. The horizontal top surface 3 with the club face alignment marks 4 is the top surface of a relatively thin ground plate portion 25. The ground plate portion preferably has vertically oriented holes 20 for stakes to hold the guide in a fixed position on the ground. Golf tees can be used for stakes, as shown in FIG. 11.

The second embodiment is preferably formed in approximately equal left and right halves to allow separation or folding into a compact form for carrying. Two possible joining methods are shown in FIGS. 10 and 11. FIG. 10 shows a hinge holding the two halves together, allowing them to fold against each other for compact storage. FIG. 11 shows an overlapping joint with at least one vertically oriented hole 20 to receive a stake that passes through a portion of both halves of the guide, holding them together on the ground.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A golf stroke training device comprising:

a curved vertical guide surface, in the form of a vertical extrusion of a substantially elliptical arc in a horizontal plane, that guides the heel of a golf club along a desired path;

a generally horizontal top surface attached to the guide surface; and a series of club face alignment marks on the top surface, each of which is a line perpendicular to an imaginary horizontal line tangent to the guide surface at the alignment mark;

whereby a golfer can move the heel of a golf club head along the guide surface, and visually align the club face with the alignment marks.

2. The golf stroke training device of claim 1, having a generally L-shaped sectional form, for sections taken on a vertical plane passing through any of the alignment marks, comprising a generally horizontal portion supporting a generally vertical portion that includes the guide surface, and wherein the generally horizontal portion includes a plurality of vertically oriented holes for receiving stakes to fix the training device to the ground.

3. The golf stroke training device of claim 2, wherein the golf stroke training device is formed in approximately equal left and right halves, releasably joined in the middle.

4. The golf stroke training device of claim 2, wherein the golf stroke training device is formed in approximately equal left and right halves with an overlapping central joint having at least one vertically oriented hole for receiving a stake that passes through a portion of each half of the guide to hold the halves together on the ground.

5. The golf stroke training device of claim 2, wherein the golf stroke training device is formed in approximately equal left and right halves, joined in the middle by a hinge.

6. The golf stroke training device of claim 1, wherein the vertical guide surface has the form of a vertical extrusion of a portion of an ellipse according to the equation $$Y = \pm \frac{B}{R}\sqrt{R^2 - X^2}$$

where the ellipse is in a horizontal plane using an x, y coordinate system whose origin is the geometric center of the ellipse, the x direction is positive to the right and the y direction is positive forward relative to a golfer using the golf stroke training device, B is the horizontal distance from the center of a desired swing circle to a golf ball to be struck, and R is the radius of the desired swing circle.

7. The golf stroke training device of claim 1, comprising a guide block having front, back, and top surfaces, the generally horizontal top surface is the top surface of the guide block, the vertical guide surface is the front surface of the guide block, the back surface of the guide block is undercut, and the top surface of the guide block has a back half with a laterally elongated carrying grip hole.

8. A golf stroke training device, comprising:

a guide block placed on a golfing surface between a golfer and a golf ball, the guide block having a curved vertical front surface facing the golf ball, the front surface having the form of a vertical extrusion of an arc in a horizontal plane, the arc being substantially a projection on a horizontal plane of a circular swing path of a golf club head, the swing path being in a plane that is neither horizontal nor vertical;

the guide block having a top surface with a series of club head alignment marks, each of which mark extends back from the front surface in a direction that is perpendicular to an imaginary horizontal line tangent to the front surface at the mark;

whereby the heel of a golf club putter head can slide along the front surface of the guide block in a desired swing circle, and the alignment marks visually align the club head to produce a stroke such that the club shaft and club head rotate in unison about a single axis.

9. The golf stroke training device of claim 8, wherein the front surface of the guide block has the form of a vertical extrusion of a portion of an ellipse according to the equation $$Y = \pm \frac{B}{R}\sqrt{R^2 - X^2}$$

where the ellipse is in a horizontal plane using an x, y coordinate system whose origin is the geometric center of the ellipse, the x direction is positive to the right and the y direction is positive forward relative to a golfer using the golf stroke training device, B is the horizontal distance from the center of a desired swing circle to a golf ball to be struck, and R is the radius of the desired swing circle.

10. The golf stroke training device of claim 8, wherein the front surface of the guide block has the form of a vertical extrusion of a circular arc that approximates a portion of a vertical projection onto a horizontal plane of a desired swing circle of a golf club head.

11. The golf stroke training device of claim 8, wherein the guide block is laterally symmetric with an elliptically curved vertical front surface and an undercut back surface, and the top surface has a back half with a laterally elongated carrying grip hole.

12. The golf stroke training device of claim 8, wherein the guide block has an approximately L-channel cross section taken on a section line between the golfer and the ball, comprising a horizontal ground plate portion supporting the vertical front surface, and the ground plate portion has at least two vertical holes to receive ground stakes.

13. The golf stroke training device of claim 12, wherein the guide block is formed as left and right approximate halves connected to each other by a central hinge for folding the golf stroke training device.

14. The golf stroke training device of claim 12, wherein the guide block is formed as left and right approximate halves that are releasably connected to each other.

* * * * *

UNITED STATES PATENT AND TRADEMARK OFFICE

CERTIFICATE OF CORRECTION

PATENT NO. : 6,561,920 B1
DATED : May 13, 2003
INVENTOR(S) : Hamilton et al.

It is certified that error appears in the above-identified patent and that said Letters Patent is hereby corrected as shown below:

Title page,
Item [12], delete "Hamilton", replace with -- Hamilton et al. --.
Item [76], Inventors, add, -- David Joseph Hamilton, Shannon, MS; and Victor John Trolio, West Point, MS; --.

Signed and Sealed this

Twenty-ninth Day of June, 2004

JON W. DUDAS
*Acting Director of the United States Patent and Trademark Office*